US006406259B1

(12) United States Patent
Schott

(10) Patent No.: US 6,406,259 B1
(45) Date of Patent: Jun. 18, 2002

(54) METHOD FOR CHANGING THE PITCH OF A CONTROLLABLE PITCH PROPELLER DURING GEAR SHIFTING OPERATIONS

(75) Inventor: Carl G. Schott, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/796,576

(22) Filed: Feb. 28, 2001

(51) Int. Cl.[7] ..... B63H 3/10
(52) U.S. Cl. ..... 416/1; 416/27
(58) Field of Search ..... 416/1, 155, 156, 416/158, 159, 162, 90 A, 244, 3, 27; 440/1, 49, 50, 87

(56) References Cited

U.S. PATENT DOCUMENTS

| | | | | |
|---|---|---|---|---|
| 2,812,026 A | | 11/1957 | Braddon | |
| 3,249,161 A | | 5/1966 | Schoenherr | |
| 4,028,004 A | | 6/1977 | Wind | 416/157 |
| 4,239,454 A | * | 12/1980 | Olson | 416/27 |
| 4,900,280 A | | 2/1990 | Midttun | 440/50 |
| 4,906,213 A | | 3/1990 | Esthimer | 440/50 |
| 4,986,776 A | * | 1/1991 | Hensel et al. | 440/87 |
| 5,213,472 A | | 5/1993 | Dumais | 416/61 |
| 6,280,269 B1 | * | 8/2001 | Gaynor | 440/84 |

* cited by examiner

*Primary Examiner*—Edward K. Look
*Assistant Examiner*—Ninh Nguyen
(74) *Attorney, Agent, or Firm*—William D. Lanyi

(57) ABSTRACT

A control method for controlling a controllable pitch propeller during gear shifting operations monitors the gear selector switch to determine a future or impending gear shifting operation, determines the current pitch setting of a controllable pitch propeller, saves the current pitch setting, moves the blades of the controllable pitch propeller to a minimal or zero pitch setting, implements the gear change operation, and then returns the blades of the controllable pitch propeller to the original setting or the current setting by minimizing the pitch of the blades of the controllable pitch propeller prior to the shifting operation, the impact shock load on the marine propulsion system can be decreased by minimizing the resistance to propeller hub rotation caused by the blades moving through the water.

20 Claims, 2 Drawing Sheets

METHOD FOR CHANGING THE PITCH OF A CONTROLLABLE PITCH PROPELLER DURING GEAR SHIFTING OPERATIONS

BACKGROUND OF THE INVENTION

1. Field of the Ivention

The present invention generally relates to the use of a controllable pitch propeller and, more particularly, to a means for manipulating the pitch setting of a controllable pitch propeller during gear shifting operations from neutral to an in-gear setting or from a first in-gear setting to a second in-gear setting.

2. Description of the Prior Art

Many different types of controllable pitch propellers are well known to those skilled in the art. U.S. Pat. No. 4,906,213, which issued to Esthimer on Mar. 6, 1990, describes an apparatus for detecting the pitch of a marine controllable pitch propeller. The pitch is detected by a motion/DC current transducer in the propeller hub. Circuitry rotating with the propeller shaft converts an AC power signal to DC for energization of the transducer and converts a DC output signal from the transducer to AC. The AC power and output signals are transferred from the rotating circuitry to a stationary circuit in the vessel hull by rotary transformers. There are no contacts between relatively moving parts of the transducer or rotary transformers, thus ensuring long life for the pitch detection system.

U.S. Pat. No. 4,900,280, which issued to Midttun on Feb. 13, 1990, describes an apparatus for detecting the pitch of a marine controllable pitch propeller. The pitch setting of a marine controllable pitch propeller is indicated with a high accuracy by comparing the positions of the portions within the vessel hull of a translating member fastened to the pitch change mechanism with the propeller hub and a non-translating member fastened adjacent one end to the hub and extending essentially free of axial load through the propeller shaft into the vessel hull.

U.S. Pat. No. 5,213,472, which issued to Dumais on May 25, 1993, describes an inboard servo for marine controllable pitch propellers. The inboard servo is of the force rod type and comprises a feedback device comprising a feedback ring located externally of the propeller driveshaft and affixed to the force rod for rotation and axial translation therewith. It also has a planar surface perpendicular to the propeller driveshaft axis and a distance-measuring device for substantially continuously detecting the position of the ring, and therefore the position of the force rod. The distance-measuring device directs a high frequency pulsed signal onto the ring surface from a fixed position spaced apart therefrom, detects the signal as it is reflected by the ring surface from a fixed position spaced apart therefrom, and processes the directed and reflected signals to produce a signal indicative of the position of the ring surface based on the time difference between the pulses directed onto the ring surface and the pulses reflected from the ring surface.

U.S. Pat. No. 4,028,004, which issued to Wind on Jun. 7, 1977, describes a feathering controllable pitch propeller. The propeller has blades carried by a hub and a hydraulic actuator housed in the hub and coupled to the blades for altering the pitch angle of the blades in both directions, astern and ahead, and also beyond the ahead to a feathered position. A servo-control system controls the actuator to adjust the blade pitch angle, the control system having a blade position feedback loop by which the system operates with positional feedback over the range of pitch angle between astern and full ahead pitch angles. However, the demand signal for blade feathering renders the feedback loop inoperative, and the hydraulic actuator then moves the blades into the feathering position without feedback action.

U.S. Pat. No. 3,249,161, which issued to Schoenherr on May 3, 1966, describes a feathering controllably pitch propeller. The invention relates to marine propellers and more particularly to a propeller which will reduce the fluctuations of the propeller forces and thus minimize vibrations.

U.S. Pat. No. 2,812,026, which issued to Braddon on Nov. 5, 1957, describes a variable pitch propeller control system. The invention relates to systems for controlling the pitch of the blades of variable pitch propellers and, particularly, to improvements in power actuating and regulating devices for such systems as applied in the field of marine propulsion.

One characteristic that is incumbent in most marine propulsion systems is that a shock load is typically experienced by the propulsion system when the transmission is moved from neutral to either forward or reverse gear or, alternatively, if the transmission is moved from forward to reverse or from reverse to forward. One cause of this shock load, which produces an audible sound, is that the "dog clutch" or "cone clutch" of the marine propulsion system provides no mechanical damping during the shifting operation. Since the clutch is used to connect, in torque transmitting relation, a torque transmitting shaft with a stationary propeller hub, the initial resistance to movement exhibited by the propeller hub creates the impact sound. The propeller hub has inertia because of its mass and shape. In addition, the blades of the propeller experience resistance to rotation about the propeller shaft axis because this rotation is resisted by the presence of water that must be moved by the propeller blades in order for rotation of the propeller to be possible.

In would therefore be significantly beneficial if a method could be provided to reduce the shock load on the marine propulsion system when the transmission is shifted into an in-gear setting from either the neutral gear setting or another in-gear setting.

SUMMARY OF THE INVENTION

A method for operating a controllable pitch propeller of a marine propulsion system, according to a preferred embodiment of the present invention, comprises the steps of monitoring a gear condition status, recognizing a future occurrence of a change in gear condition status, and determining a current pitch setting of the controllable pitch propeller. The method of the present invention further comprises of causing the controllable pitch propeller to change from the current pitch setting to a gear shifting pitch setting before the gear condition status changes and changing the controllable pitch propeller from the gear shifting pitch setting to a subsequent pitch setting after the gear condition status changes.

The gear shifting pitch setting, in a preferred embodiment of the present invention, is a lower pitch setting than the current pitch setting. The subsequent pitch setting is generally equal to the current pitch setting. The gear shifting pitch setting can be generally equal to a zero pitch setting.

The future occurrence of a change in gear condition status can be either a change from a neutral position to a forward position, or a change from one in-gear position to another in-gear position.

The monitoring step of the present invention can comprise a step of receiving a signal from a gear selector switch. The monitoring and recognizing steps can be performed by a microprocessor and the microprocessor can be a part of a propulsion control module (PCM).

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
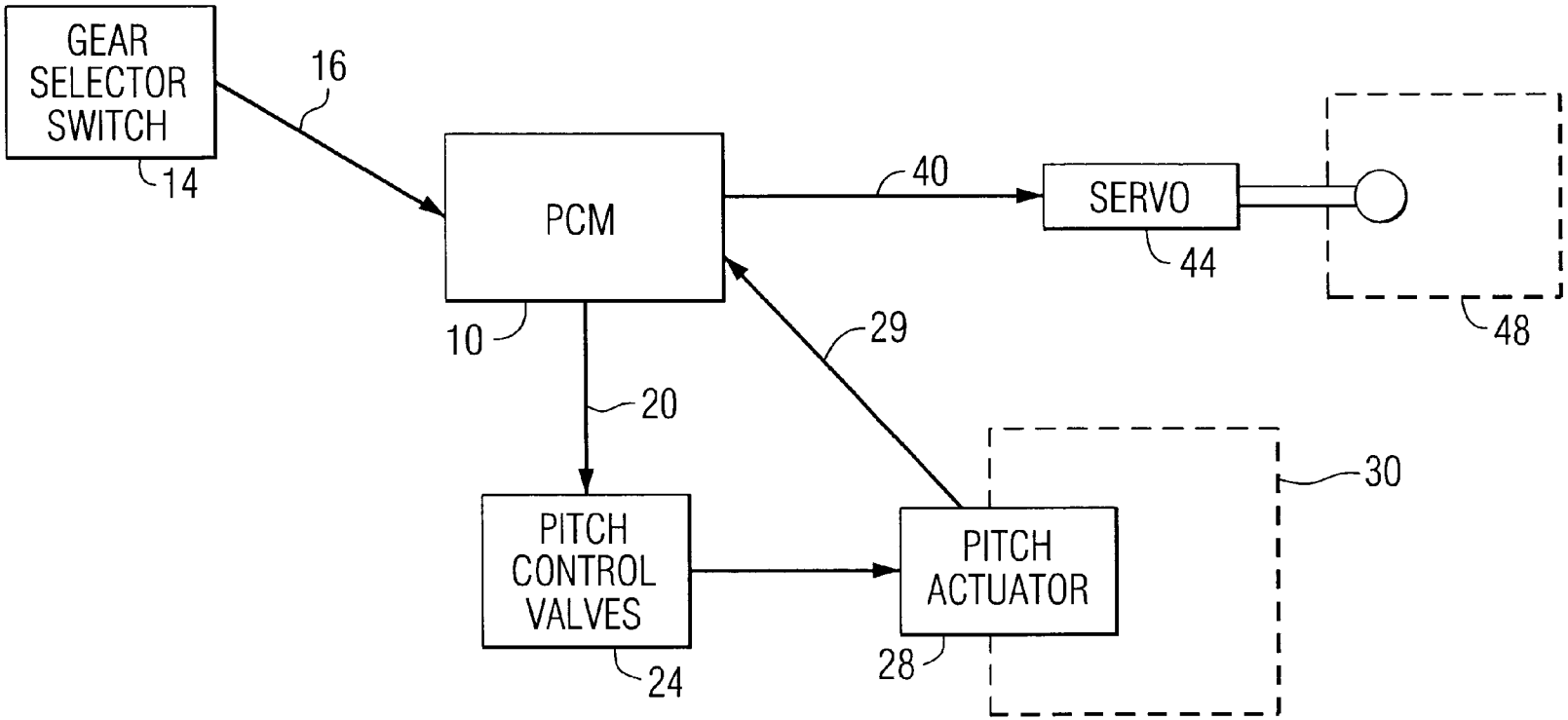
FIG. 1 is a schematic representation of a marine propulsion system for implementing the present invention.

Throughout the description of the preferred embodiment of the present invention, like components will be identified by like reference numerals.

FIG. 1 is a schematic representation of a marine propulsion system and, more particularly, the propulsion control module 10 along with associated gear selector and pitch selector components. The propulsion control module (PCM) 10 receives a signal from a gear selector switch 14, as represented by arrow 16. This gear selector switch can be any one of several types of switch. For example, it may be a manually activated push button operated by the operator of the marine vessel or, alternatively, it may be a switch within the gear selector mechanism that provides a signal on line 16 whenever the gear selector handle is moved out of a neutral selection position. Regardless of the specific type of gear selector switch 14 used, the signal on line 16 provides an indication of a future change in the gear condition status.

The propulsion control module 10 provides a signal, on line 20, to one or more pitch control valves 24 that control the flow of hydrostatic fluid to a pitch actuator 28. Although FIG. 1 specifically illustrates a hydrostatic pitch control system, it should be understood that other types of pitch control systems are also within the scope of the present invention. The switch actuator 28 moves the blades of a controllable pitch propeller 30 which is represented with a simple dashed line box in FIG. 1. Many different types of controllable pitch propellers are well known to those skilled in the art and the specific details of the controllable pitch propeller 30 are not directly relevant or limiting to the present invention.

The pitch actuator 28 provides a signal 29 to the propulsion control module 10 which represents the status of the pitch actuator 28. In other words, by monitoring the signal received on line 29, the propulsion control module 10 can monitor the current pitch setting of the blades of the controllable pitch propeller 30.

The propulsion control module 10 also provides a signal 40 to a servo mechanism 44 that physically changes the gear position of a transmission 48 of the marine propulsion system.

In operation, an operator of a marine vessel manually takes some action that causes the gear selector switch 14 to provide a signal on line 16 to the propulsion control module 10. This signal on line 16 is responded to by the propulsion control module 10 by its causing the servo mechanism 44 to change the gear setting of the transmission 48. However, before the gear position is actually changed, the propulsion control module 10 first causes the pitch actuator 28 to move the pitch of the blades of the controllable pitch propeller 30 to a shifting pitch which can be the minimum or possibly a zero pitch of the controllable pitch propeller 30.

Figure 2:
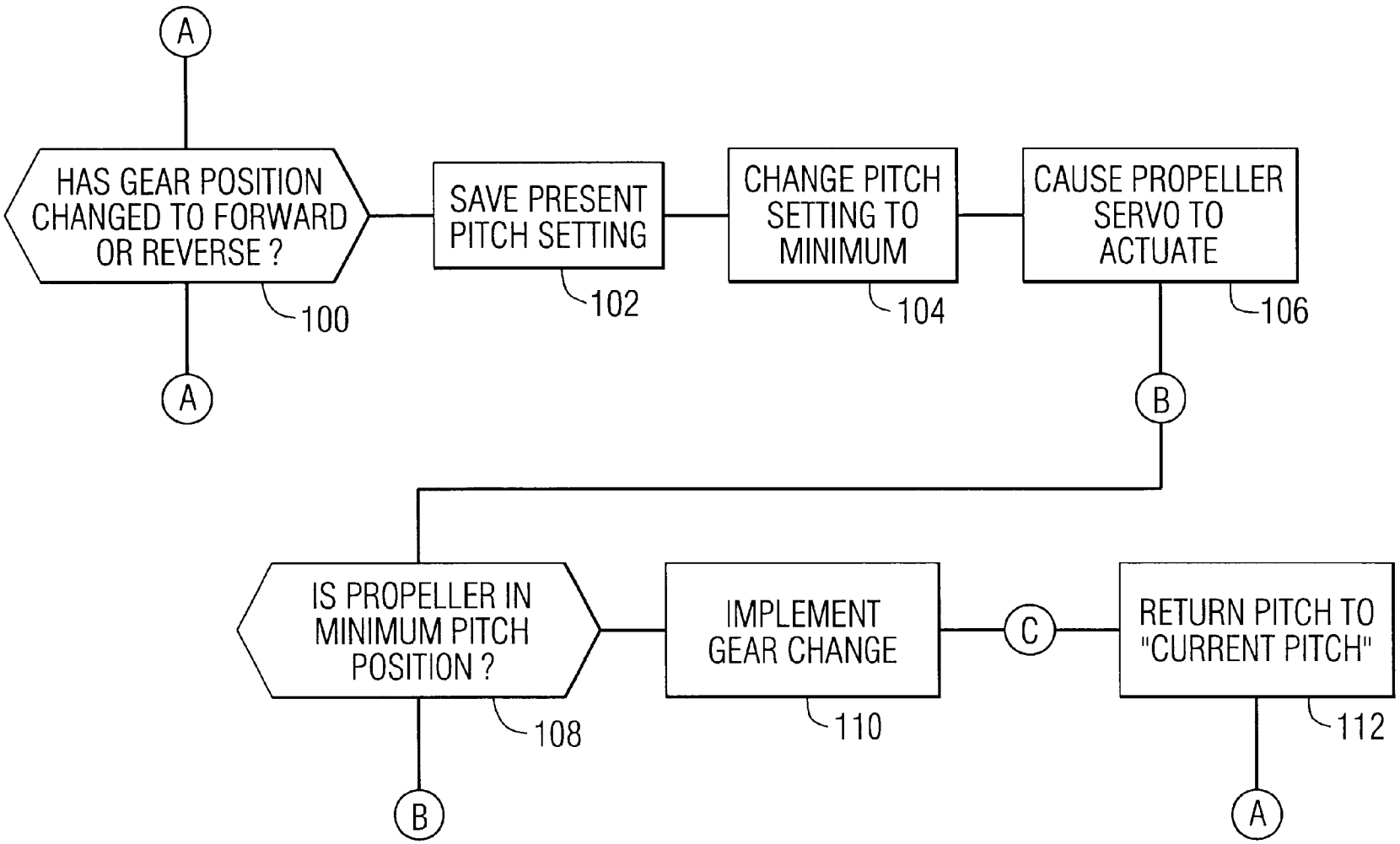
FIG. 2 is a simplified flow chart of the steps of the present invention.

FIG. 2 is a simplified flow chart showing the steps of the present invention which are accomplished by propulsion control module (PCM) 10 described above in conjunction with FIG. 1. Beginning at point A, the propulsion control module 10 determines whether or not a gear selection position has changed to a forward or reverse position. It should be understood that this indicated future change can be from a neutral position to either a forward or reverse position or, alternatively, from a forward position to a reverse position or from a reverse position to a forward position. When the propulsion control module 10 recognizes that a future occurrence of a change in the gear condition status is likely to occur, it determines the current pitch setting of the controllable pitch propeller 30 and saves the setting. This is represented by functional block 102 in FIG. 2. It then causes the controllable pitch propeller to change from the current pitch setting to a gear shifting pitch setting as represented by functional block 104. This gear shifting pitch setting is represented as a minimum pitch setting in functional block 104, but it should be recognized that alternative schemes are also within the scope of the present invention. The change of pitch described in functional block 104 precedes the propeller servo 44 being actuated as described in functional block 106. The propeller is then monitored by observing the status of the signal on line 29, as represented by functional block 108. When the propeller has moved to its minimum pitch position, the actual gear change is physically implemented by the propulsion control module 10 by providing a signal on line 40 to the servo 44. This is represented by functional block 110 in FIG. 2. The program then returns to the beginning of the flow chart to repeat the monitoring process. It should be recognized that the flow chart in FIG. 2 is highly simplified in order to describe the basic steps of the present invention.

With reference to FIGS. 1 and 2, it can be seen that the method of the present invention comprises the step of monitoring a gear condition status, as represented by the signal on line 16 from the gear selector switch 14. This allows the propulsion control module 10 to recognize a future occurrence of a change in the actual gear condition status, either from neutral to a forward or reverse gear or, alternatively, from either forward to reverse gear or from reverse to forward gear. The propulsion control module 10 then determines the pitch setting, by observing the position status signal on line 29, saves the present pitch setting as represented by functional block 102 in FIG. 2, and then causes the controllable pitch propeller 30 to change from the current pitch setting to a gear shifting pitch setting, such as minimum or zero pitch, before the physical gear condition status actually changes. This is followed by the changing of the gear condition status which is accomplished by providing a signal on line 40 to the servo mechanism. The present invention then changes the controllable pitch propeller from the gear shifting pitch setting to a subsequent pitch setting, as represented by functional block 112 in FIG. 2 which is the current pitch setting in a preferred embodiment of the present invention.

If the marine vessel is operating in neutral gear and the pitch setting of the blades of the controllable pitch propeller are set to, hypothetically, 12° forward pitch, the propulsion control module 10 would store the magnitude of this current pitch, which is 12°, move the propeller blades to a zero or minimum pitch setting for gear setting purposes, cause the gears to move from the neutral position to the commanded position (e.g. forward position), and then return the propeller pitch to 12°.

It is anticipated that the gear shifting pitch setting is a lower pitch setting than the current pitch setting. This lower pitch setting used for gear shifting can be either a zero pitch setting or the lowest possible pitch setting achievable by the control pitch propeller. The subsequent pitch setting, selected after the gear shifting process is complete, is typically equal to the current pitch setting that was monitored and saved prior to the gear shifting process being initiated.

By changing the pitch of the controllable pitch propeller to a minimum gear shifting setting, the shifting impact normally experienced by marine propulsion systems can be significantly reduced or essentially eliminated.

Although the present invention has been described with particular detail and illustrated with specificity to show a preferred embodiment, it should be understood that alternate embodiments are also within its scope.

I claim:

1. A method for operating a controllable pitch propeller of a marine propulsion system, comprising the steps of:

monitoring a gear condition status;

recognizing a future occurrence of a change in said gear condition status;

determining a current pitch setting of said controllable pitch propeller;

causing said controllable pitch propeller to change from said current pitch setting to a gear shifting pitch setting before said gear condition status changes; and changing said controllable pitch propeller from said gear shifting pitch setting to a subsequent pitch setting after said gear condition status changes.

2. The method of claim 1, wherein:

said gear shifting pitch setting is a lower pitch setting than said current pitch setting.

3. The method of claim 1, wherein:

said subsequent pitch setting is generally equal to said current pitch setting.

4. The method of claim 1, wherein:

said gear shifting pitch setting is generally equal to a zero pitch setting.

5. The method of claim 1, wherein:

said future occurrence of a change in said gear condition status is a change from a neutral position to a forward position.

6. The method of claim 1, wherein:

said future occurrence of a change in said gear condition status is a change from a neutral position to an in-gear position.

7. The method of claim 1, wherein:

said future occurrence of a change in said gear condition status is a change from an in-gear position to a neutral position.

8. The method of claim 1, wherein:

said future occurrence of a change in said gear condition status is a change from a first in-gear position to a second in-gear position.

9. The method of claim 1, wherein:

said monitoring step comprises a step of receiving a signal from a gear selector switch.

10. The method of claim 1, wherein:

a microprocessor performs the monitoring and recognizing steps.

11. The method of claim 10, wherein:

said microprocessor is a part of a propulsion control module.

12. A method for operating a controllable pitch propeller of a marine propulsion system, comprising the steps of:

monitoring a gear condition status;

determining when a change in said gear condition status will occur;

storing a current pitch setting of said controllable pitch propeller;

causing said controllable pitch propeller to change from said current pitch setting to a gear shifting pitch setting before said gear condition status changes; and causing said controllable pitch propeller to change from said gear shifting pitch setting to a subsequent pitch setting after said gear condition status changes, said gear shifting pitch setting being a lower pitch setting than said current pitch setting, said subsequent pitch setting being generally equal to said current pitch setting.

13. The method of claim 12, wherein:

said gear shifting pitch setting is generally equal to a zero pitch setting.

14. The method of claim 13, wherein:

said change in said gear condition status is a change from a neutral position to a forward position.

15. The method of claim 14, wherein:

said change in said gear condition status is a change from a neutral position to an in-gear position.

16. The method of claim 12, wherein:

said monitoring step comprises a step of receiving a signal from a gear selector switch.

17. The method of claim 16, wherein:

a microprocessor performs the monitoring and recognizing steps.

18. The method of claim 17, wherein:

said microprocessor is a part of a propulsion control module.

19. A method for operating a controllable pitch propeller of a marine propulsion system, comprising the steps of:

monitoring a gear condition status represented by a gear selector switch;

determining when a change in said gear condition status will occur as indicated by said gear selector switch, said change in said gear condition status being a change from a neutral position to an in-gear position;

storing a current pitch setting of said controllable pitch propeller;

causing said controllable pitch propeller to change from said current pitch setting to a gear shifting pitch setting before said gear condition status changes; and causing said controllable pitch propeller to change from said gear shifting pitch setting to a subsequent pitch setting after said gear condition status changes, said gear shifting pitch setting being a lower pitch setting than said current pitch setting, said subsequent pitch setting being generally equal to said current pitch setting, said gear shifting pitch setting being generally equal to a zero pitch setting.

20. The method of claim 19, wherein:

said future occurrence of a change in said gear condition status is a change from a neutral position to a forward position, said monitoring step comprising a step of receiving a signal from a gear selector switch, said monitoring and recognizing steps being performed by a microprocessor, said microprocessor being a part of a propulsion control module.

* * * * *